US009528758B2

(12) United States Patent
Nilsen

(10) Patent No.: US 9,528,758 B2
(45) Date of Patent: Dec. 27, 2016

(54) METHOD AND SYSTEM FOR REGULATION OF COOLING CAPACITY OF A COOLING SYSTEM BASED ON A GAS EXPANSION PROCESS

(75) Inventor: Inge L. Nilsen, Bergen (NO)

(73) Assignee: ARAGON AS, Bergen (NO)

( * ) Notice: Subject to any disclaimer, the term of this patent is extended or adjusted under 35 U.S.C. 154(b) by 1048 days.

(21) Appl. No.: 12/734,937

(22) PCT Filed: Dec. 5, 2008

(86) PCT No.: PCT/NO2008/000434
§ 371 (c)(1),
(2), (4) Date: Jun. 7, 2010

(87) PCT Pub. No.: WO2009/072900
PCT Pub. Date: Jun. 11, 2009

(65) Prior Publication Data

US 2010/0236286 A1 Sep. 23, 2010

(30) Foreign Application Priority Data

Dec. 6, 2007 (NO) ..... 20076291

(51) Int. Cl.
*F25J 3/06* (2006.01)
*F25J 1/02* (2006.01)
(Continued)

(52) U.S. Cl.
CPC ..... *F25J 1/0236* (2013.01); *F25B 9/02* (2013.01); *F25J 1/005* (2013.01); *F25J 1/0022* (2013.01);
(Continued)

(58) Field of Classification Search
CPC ..... F25J 1/0249
(Continued)

(56) References Cited

U.S. PATENT DOCUMENTS 3,792,590 A * 2/1974 Lofredo ..... F25J 1/0022 62/47.1
5,636,529 A * 6/1997 Schmidt ..... 62/613
(Continued)

FOREIGN PATENT DOCUMENTS

JP 2007-192531 8/2007

*Primary Examiner* — John F Pettitt
*Assistant Examiner* — Tareq Alosh
(74) *Attorney, Agent, or Firm* — Francis C. Hand; Carella, Byrne, et al

(57) ABSTRACT

A method and associated system for regulation of the cooling capacity of a cooling system that uses a gas expansion cooling circuit where the cooling principle is expansion of one or more gaseous cooling medium streams from a higher pressure to a lower pressure are described, characterised by the following steps: —reducing the amount of cooling medium which is circulated in the cooling circuit (100) temporarily in that a fraction of gaseous cooling medium is pre-cooled at a higher pressure and is extracted from the cooling circuit (100), —expanding the fraction of cooled gaseous cooling medium across an expansion device (102) to a lower pressure so that at least one part of liquid cooling medium separates, —separating the liquid from the non-condensed gas for temporary storage in a storage unit (104) so that the liquid is temporarily not circulated in the otherwise closed cooling circuit (100), —thereafter to return temporarily stored gaseous cooling medium from the storage unit (104) to the cooling circuit (100) according to need, and—returning non-condensed gas and evaporated cooling medium from the storage unit (104) to a suitable location in the cooling circuit (100). A system to reduce the cooling capacity of a cooling installation based on gas expansion cooling, is also described.

7 Claims, 12 Drawing Sheets

(51) Int. Cl.
*F25B 9/02* (2006.01)
*F25J 1/00* (2006.01)

(52) U.S. Cl.
CPC ..... *F25J 1/0052* (2013.01); *F25J 1/0072* (2013.01); *F25J 1/0204* (2013.01); *F25J 1/0212* (2013.01); *F25J 1/0245* (2013.01); *F25J 1/0249* (2013.01); *F25J 1/0278* (2013.01); *F25J 1/0288* (2013.01); *F25J 1/0294* (2013.01); *F25J 1/0298* (2013.01); *F25B 2400/23* (2013.01); *F25J 2220/64* (2013.01); *F25J 2240/60* (2013.01); *F25J 2270/16* (2013.01); *F25J 2280/02* (2013.01); *F25J 2290/62* (2013.01)

(58) Field of Classification Search
USPC ..... 62/611, 613, 614
See application file for complete search history.

(56) References Cited

U.S. PATENT DOCUMENTS

2003/0089125 A1* 5/2003 Fredheim et al. ..... 62/612
2005/0091991 A1 5/2005 Roldan Villalobos

* cited by examiner

METHOD AND SYSTEM FOR REGULATION OF COOLING CAPACITY OF A COOLING SYSTEM BASED ON A GAS EXPANSION PROCESS

The present invention relates to a method and a system to regulate the cooling capacity of a cooling system based on a gas expansion process.

Cooling processes based on gas expansion as cooling principle are often used where a simple and robust cooling installation is required for cooling a gas or liquid to very low temperatures, such as liquefaction of natural gas to LNG, or in cryogenic separation of air. The gas expansion process is normally based on the classic Brayton/Claude cooling process where a gaseous cooling medium goes through a work cycle based on compression, cooling, expansion and thereafter, heat exchange with the fluid that is to be cooled down. For example, for liquefaction of natural gas one can use a pre-cooled, compressed cooling medium in a gas phase, normally nitrogen or a hydrocarbon gas, or a mixture, which is pre-cooled and expanded across a turbine (for example, a radial turbine/turbo expander) or an expansion valve. The gas expansion leads to the generation of a very cold gas, or a mixture of gas and liquid, which is then used to liquefy natural gas and to pre-cool the compressed cooling gas. The gas expansion processes are relatively simple and therefore well suited for offshore installation. The processes can be based on a single expansion loop, or have two or more expansion steps coupled in parallel or in series, where the different expansion steps operate at different processing conditions (pressure, temperature, amount of flow) to increase the efficiency of the process. However, common for most of the processes is that the cooling medium is predominantly present in gas phase throughout the entire process.

As the cooling medium in gas expansion processes predominantly is present in gas phase through the entire system, the capacity regulation of these processes will often be challenging. Capacity regulation is relevant when less cooling work is required to carry out a desired cooling and/or liquefaction, for example, when less fluid that shall be cooled or condensed flows through the system, or when the fluid that shall be cooled or liquefied changes composition such that specific cooling work is reduced. Reduced capacity can, to a limited extent, be achieved by reducing the cooling medium compressor duty, for example, by variable inlet guide vanes, or speed control, or gas recycling from the discharge back to the compressor suction. However, by reducing the cooling medium volume flow rate, the expansion turbines will also provide a reduced efficiency and lower power output, or more seriously that problems will arise with control of the expansion turbine, or that the expansion turbines can not be operated over time in such an operating range. Then a situation can arise where the desired low temperature, which is necessary for the process, can not be achieved.

As a consequence of the equipment related limitations for reduction of cooling capacity in the process, another principle is normally used, in that the content of cooling medium in the closed cooling circuit is reduced (is removed permanently or temporarily from the closed loop). In this way, the operating pressure in the whole cooling circuit will be reduced, both on the high pressure side and the low pressure side. Normally, radial compressors and radial turbines are used in such cooling processes, and since compression or expansion in these machines is volume based the equipment will continue to handle a relatively fixed actual volume per unit time. By reducing the operating pressures, the same actual volume flow will be circulated, but the mass flow will be lower. In this way, a lower cooling duty is achieved with a corresponding reduction of necessary compression work, while the system will operate close to its design points.

The challenge with the latter method for capacity regulation is loss of cooling gas in case of a temporary reduction of the cooling capacity. In a large installation, one will, for example, have to use a very long time to supply large amounts of cooling medium gas of proper quality, for example, purified nitrogen, after a period with capacity reduction. Hence, it will take long time to re-establish the capacity again. Alternatives with storage or "trapping" of gas between the two pressure levels the process operates between are used, and will constitute a reasonable alternative for small installations. Other solutions comprise storage of cooling medium gas in pressure containers so that large amounts of gas can be injected into the cooling circuit when additional amounts are required.

The present invention represents a considerable optimisation of the capacity regulation of a gas expansion circuit, and in particular for large installations, such as a cooling installation for production of LNG, in that the cooling process is modified in such a way that the cooling medium gas can simply be cooled down and liquefied within a relatively short time, for intermediate storage in liquid form, and in this way be removed temporarily from the cooling circuit. The cooling circuit will then operate at a lower filling rate with subsequent lower operating pressure and reduced cooling duty. The liquefied gas can at any time be evaporated into the cooling circuit again to quickly increase the duty of the cooling installation. Storage of cooling medium gas in the liquid form at low temperature will require considerably smaller storage volumes than storage of the gas in compressed form. Liquefaction of the cooling medium gas does not require large cooling capacity in the cooling installation, as the liquefaction is carried out over a short period when the duty of the installation is being reduced and there is an excess of cooling capacity in the installation.

The invention is intended for use in all types of gas expansion circuits where the cooling medium is predominantly in gas phase throughout the entire cooling circuit, such as all types of nitrogen expansion cycles, or gas expansion cycles that use pure methane, natural gas or a mixture of hydrocarbons, and where cooling is obtained by expanding the gaseous cooling medium.

The abovementioned objects are achieved with a method for controlling the cooling capacity of a cooling system that uses a cooling circuit for gas expansion cooling by the steps:

- to temporarily reduce the amount of cooling medium which is circulated in the cooling circuit, in that a fraction of the cooling medium is pre-cooled at a higher pressure and is removed from the cooling circuit,
- to expand the fraction of cooled cooling medium, which now is either in a gas phase or in a liquid phase, across an expansion device to a lower pressure so that at least a fraction of the cooling medium separates as a cold liquid,
- to separate the condensed liquid from the non-condensed gas for temporary storage in a storage unit so that the liquid is temporarily not circulated in the otherwise closed cooling circuit,
- thereafter to return the temporary stored liquid phase cooling medium from the storage unit to the cooling circuit when needed, and to return non-condensed gas and evaporated cooling medium from the storage unit to a suitable location in the cooling circuit.

The above mentioned objects are achieved with a system for capacity reduction in a cooling system based on gas expansion cooling comprising:

a device for cooling a gaseous cooling medium at a higher pressure in a heat exchanger or in a system of heat exchangers with the assistance of a cooling process, an outlet for a side stream of cooled cooling medium in a gas phase or in a liquid phase, an expansion device for expansion of the side stream into a stream at a lower pressure, a storage for separation of non-condensed cooling medium and temporary storage of condensed cooling medium, a return device for return of non-condensed cooling medium gas and evaporated cooling medium from the storage unit to a suitable location in the cooling system, and a return device for return of cooling medium from the storage unit to the cooling circuit when needed, in that the system is set up to temporarily remove cooling medium from the closed cooling circuit or cooling circuits.

DESCRIPTION OF THE INVENTION

The invention will now be described in more detail with reference to the enclosed figures, in which.

Figure 1:
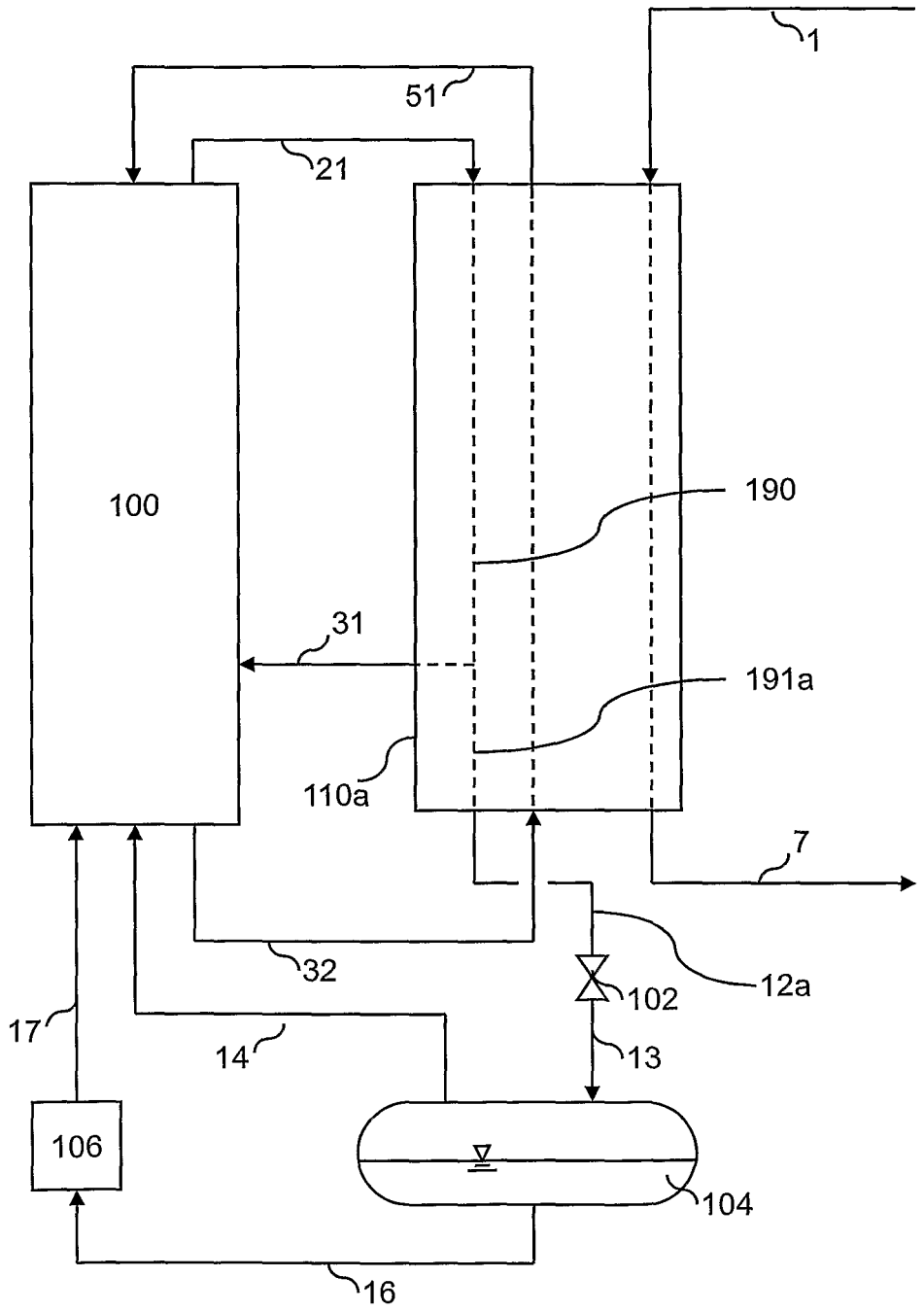
FIG. 1 shows the main operating principle of the invention.
Figure 2:
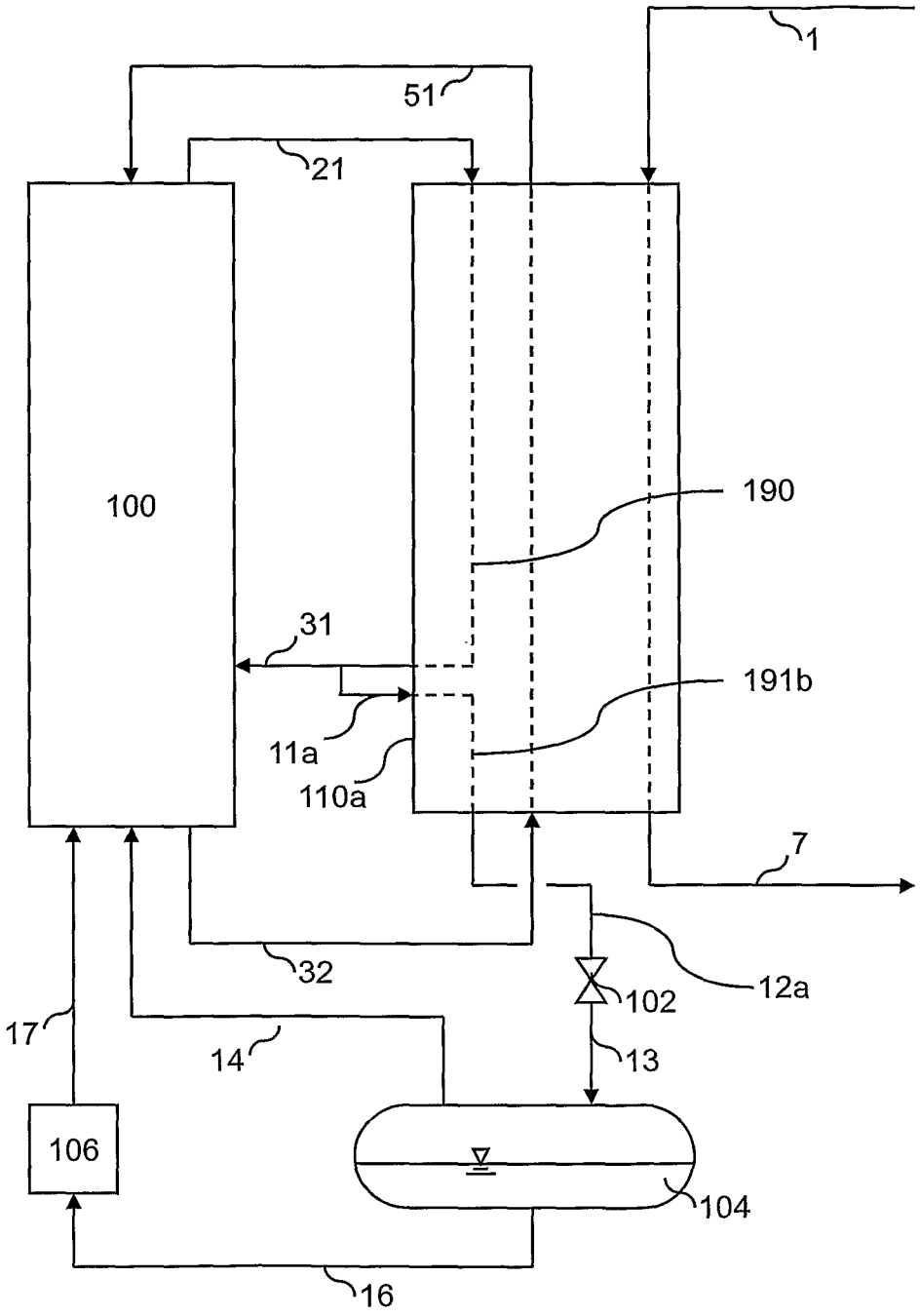
FIG. 2 shows the main operating principle of the invention with alternative embodiments.

With reference to FIG. 1 and FIG. 2, the system for capacity control of the gas expansion circuit will include the following principal components:

1. Cooling of a fraction of the cooling medium at a higher pressure by means of the cooling process 100.
2. Removal of said fraction of cooled cooling medium 12*a* for expansion across the pressure reduction device 102 to a lower pressure, so that at least a small fraction of the cooling medium in the cooling medium stream 13 is liquefied at the lower pressure.
3. A storage/tank 104 for liquid phase cooling medium.
4. Separation of cooling medium stream 13 into a stream of non-condensed cooling medium gas 14 and liquid phase cooling medium, preferably this separation takes place in the cooling medium tank 104.
5. Return of non-condensed cooling medium and also evaporated cooling medium from the tank 104 to a suitable location in the cooling system 100.
6. A device 106 for return of cooling medium from storage tank 104 to the cooling circuit 100 according to need at load increases.

The cooling of cooling medium at the higher pressure will normally be to a lower temperature than the lowest pre-cooling temperature of the cooling medium in the main cooling circuit, i.e. that the cooling medium stream which shall be extracted for expansion across the pressure reduction device 102 to a lower pressure must normally be cooled further compared to the pre-cooling of other cooling medium streams during normal operating mode for the cooling circuit. However, the pre-cooling temperature for said cooling medium stream which is to be extracted for expansion across the pressure reduction device 102 can not be cooled down to a lower temperature than the lowest operating temperature in the cooling circuit, which normally is a returning cooling medium stream that has been expanded from a higher pressure to a lower pressure, for example as shown as stream 32 in FIG. 1. In those cases the cooling system uses one or more multistream heat exchangers, for example, multistream plate-fin heat exchangers, the cooling can take place partly as a part of one of the main cooling circuit pre-cool pass 190 and partly as a dedicated extension 191*a* of this pre-cooling pass. FIG. 1 shows this embodiment as the pre-cooling pass 190 of the cooling circuit is extended directly in the form of heat exchanger pass 191*a*, while the cooling medium stream 31 of the main cooling circuit is extracted from the heat exchanger 110*a* in an intermediate outlet in the heat exchanger. FIG. 2 shows an alternative embodiment where the cooling medium is first cooled down in the cooling circuit pre-cooling pass 190 and is taken out of the heat exchanger 110*a* as stream 31. A side stream 11*a* is extracted from stream 31, and is led back to the multistream heat exchanger 110*a* for further cooling down in the heat exchanger pass 191*b*.

Figure 3:
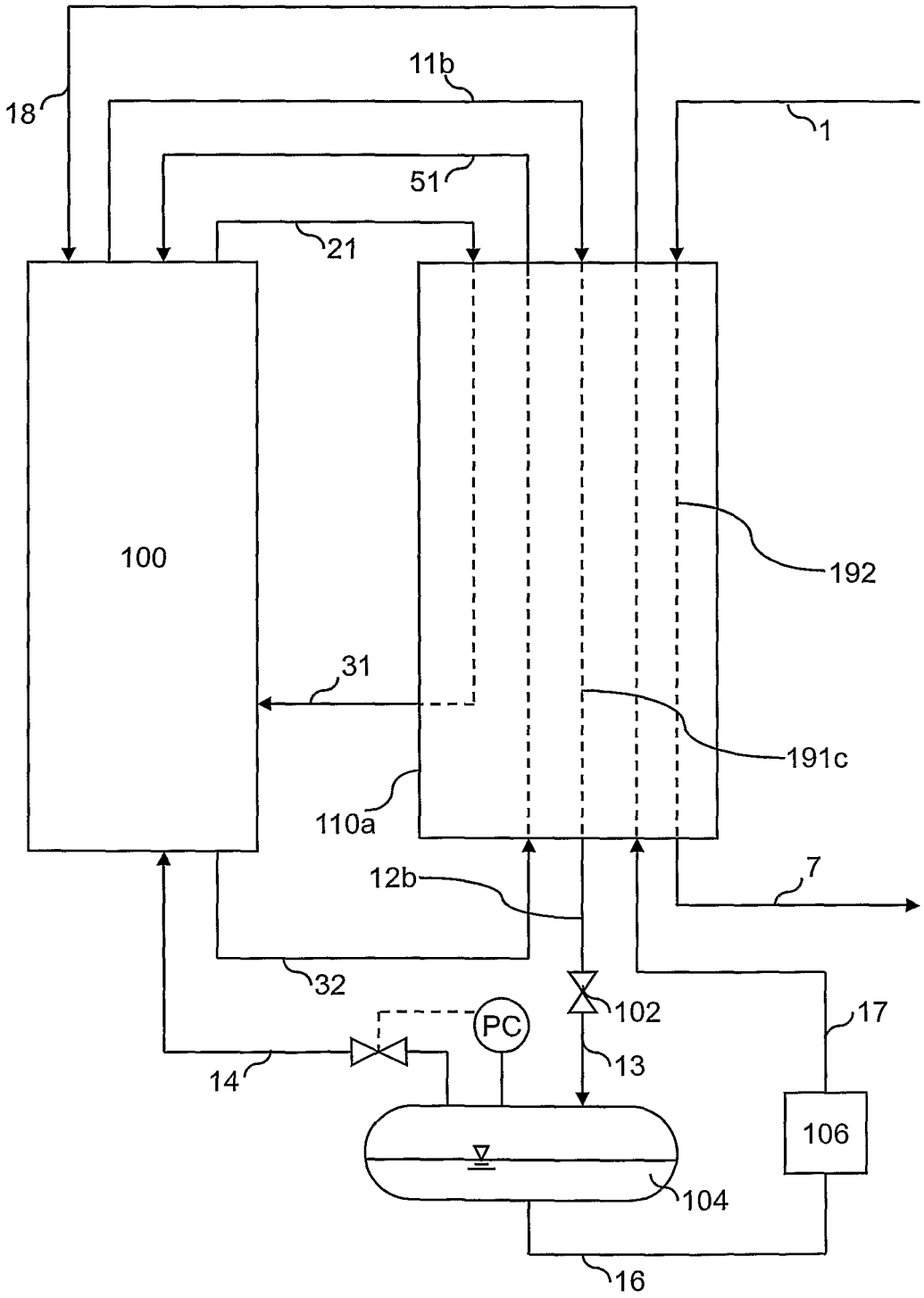
FIG. 3 shows the main operating principle of the invention with alternative embodiments.

FIG. 3 shows some more principle alternative embodiments which can be used individually or simultaneously. FIG. 3 shows an alternative embodiment where the cooling of said fraction of gaseous cooling medium is performed completely in a separate pre-cooling pass 191*c* in one or more of said multistream heat exchangers in the heat exchanger system. Alternatively, the cooling can also take place in a separate heat exchanger with the help of the cooling system 100. Furthermore, FIG. 3 shows an embodiment where the cooling medium storage 104 is operated at a higher pressure than the reception pressure for return of cooling medium, in that a pressure control valve controls the pressure in 104 by restricting the flow of gas returning to the cooling circuit. FIG. 3 also shows that return of cooling medium 12 can be done by heating in a separate pass 192 in heat exchanger 110*a*. A corresponding configuration can also be used if a system 110*b* (FIG. 5) consisting of a plurality of heat exchangers in the cooling circuit is used.

Figure 4:
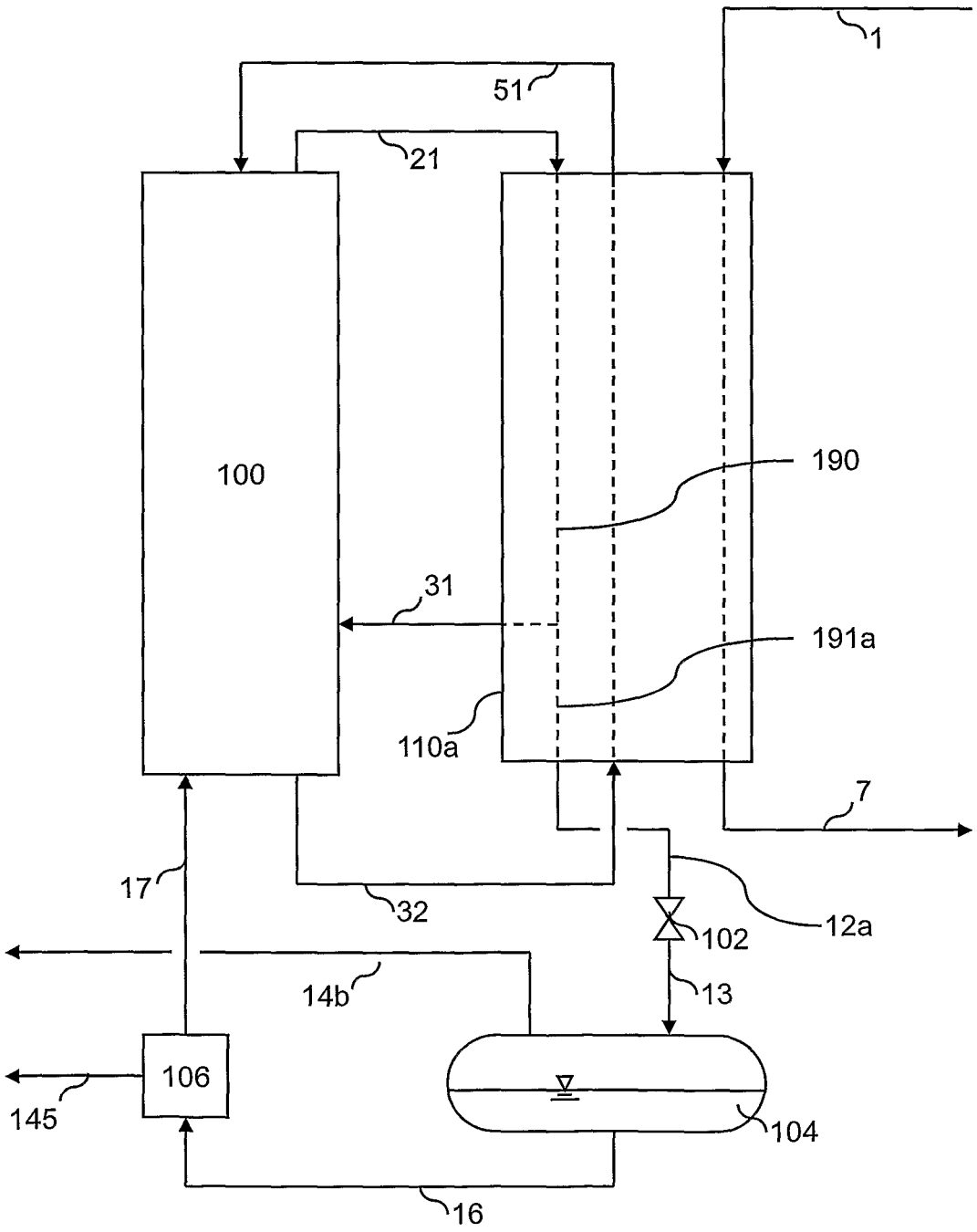
FIG. 4 shows the main operating principle of the invention with alternative embodiments.

FIG. 4 shows two alternative embodiments that can be used together or individually and together with any of the alternatives described above and in the FIGS. 1-3. In FIG. 4 the non-condensed cooling medium fraction 14 is not returned to the cooling system, but is let out of the otherwise closed cooling system as stream 14*b*, for example, to the atmosphere or for use at other locations in the process plant. FIG. 4 also shows an embodiment where the system can supply other parts of the processing installation with nitrogen as stream 145, either in the form of a liquid or a gas.

Figure 5:
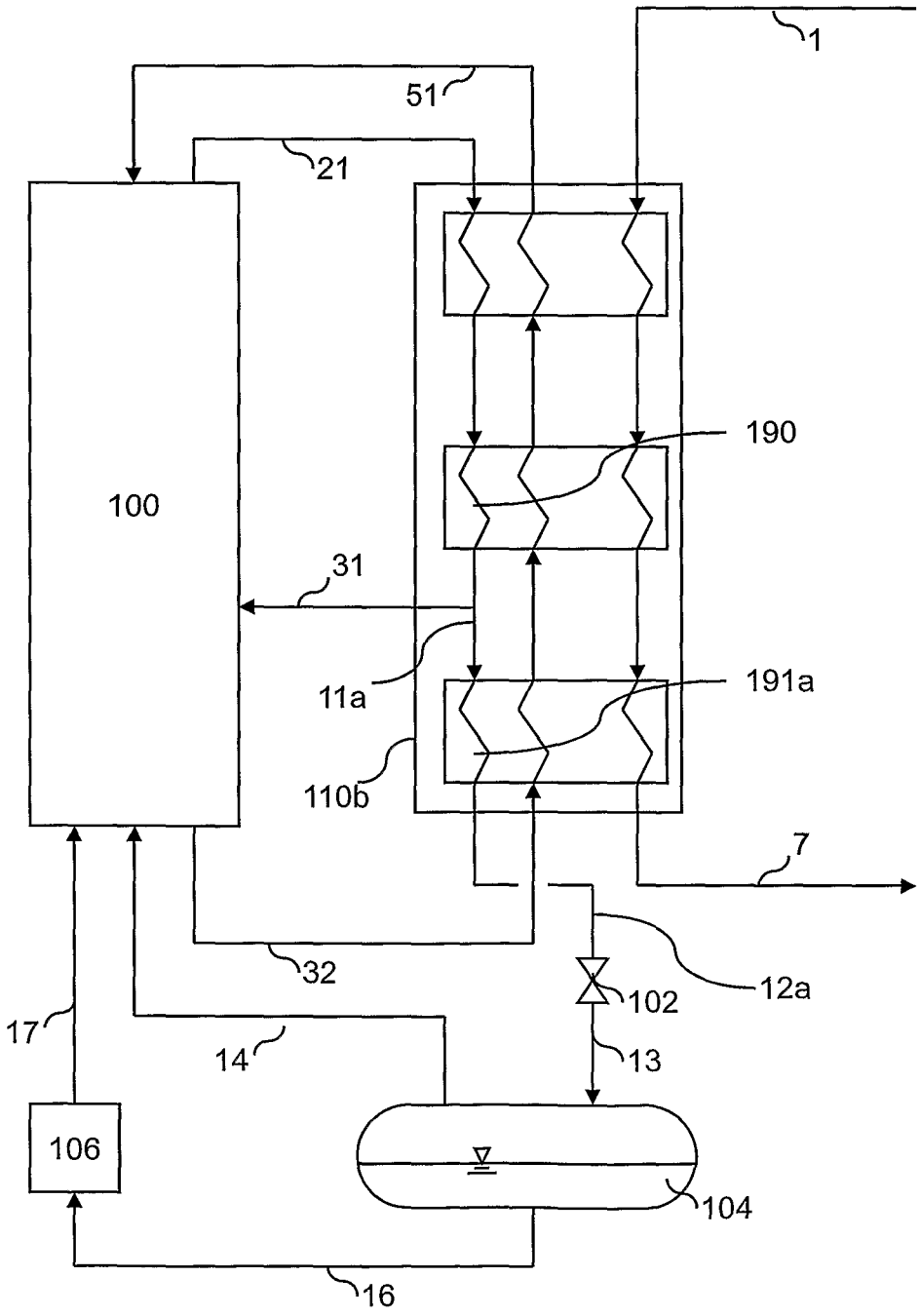
FIG. 5 shows the main operating principle of the invention with alternative embodiments.

FIG. 5 shows an alternative embodiment where the cooling process uses a plurality of multistream heat exchangers as a system of heat exchangers 110*b* and where the cooling medium is first cooled in the cooling circuit pre-cooling pass 190 and is taken out from one of the heat exchangers in the system 110*b* as stream 31. A side stream 11*a* is extracted from stream 31 and led back to the system 110*b* for further cooling in the heat exchanger pass 191*a* in the subsequent heat exchanger.

Figure 6:
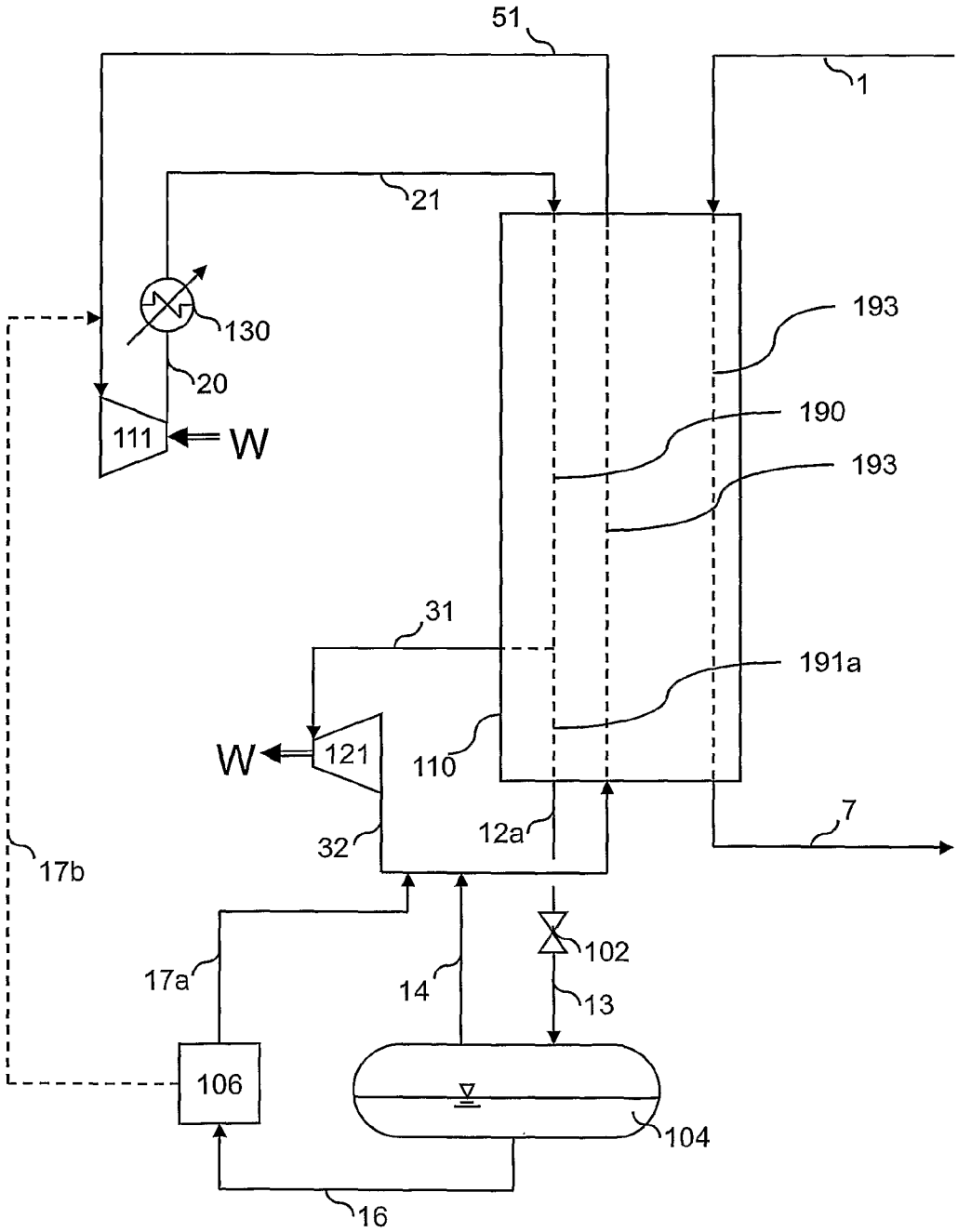
FIG. 6 shows the invention for a simple gas expansion circuit.

FIG. 6 shows in detail the invention used in a simple gas expansion circuit, for example, a simple nitrogen expander cooling circuit. It is pointed out that the invention can also be used with other types of gas expansion circuits with different types of cooling medium and with one or more expansion steps. The cooling process starts with a gaseous stream of cooling medium 21 at a higher pressure which is pre-cooled in pass 190 in the multistream heat exchanger 110 so that pre-cooled cooling medium 31 can be expanded across the gas expander 121 to generate a cold cooling medium stream 32 at a lower pressure. The stream of cooling medium 32 is predominantly in gas phase, but in some designs a small fraction of liquid in equilibrium with the gas at the outlet of the expander/turbine can be allowed. Cold cooling medium 32 is returned to the heat exchanger 110 and provides cooling of both warm cooling medium stream 21 in the cooling medium pass 190 and cooling and/or liquefaction of process fluids 1 in one or more cooling medium passes 193 in order to provide the cooled product 7 of the process. After heating in 110, the cooling medium stream exists as gas at the lower pressure in stream 51. This cooling medium stream is recompressed in one or more compression steps 111 with or without inter cooling. Compressed cooling medium 20 is then aftercooled using an external cooling medium or an external cooling circuit 130. In this context the invention starts by extracting a cooling medium stream 191*a* at the higher pressure after pre-cooling in the heat exchanger pass 190, for further pre-cooling in 191*a*, until a cold cooling medium stream 12*a* is formed at the higher pressure. Pre-cooled cooling medium 12*a* can be in the gas or liquid state and is then expanded across a valve 102 to the lower pressure or a pressure between the higher pressure and the lower pressure, but so that the temperature is reduced and a mixture 13 of gas and at least a fraction of liquid are generated. The valve 102 will in this context also reduce the amount of cooling medium that is extracted from the cooling circuit. The gas and liquid in stream 13 are separated to a liquid fraction which can be stored in a storage tank/pressure tank/separator 104 at a suitable pressure, and a gas stream 14 which is returned at a suitable location in the cooling circuit at the lower pressure, for example, to stream 32 as shown in FIG. 5. When the system described above extracts cooling medium through pass 191*a* and via the valve 102 and a liquid is generated in 104, the content of cooling medium in the cooling circuit is correspondingly reduced, and the capacity of the cooling installation is reduced. When the capacity shall be increased again, a suitable arrangement 106 is used to return cooling medium from the tank 104 to the cooling circuit via the connection 16, preferably to the part of the cooling circuit that has the lower pressure, for example, as stream 17*a* to the cold side 32 at the lower pressure, or a stream 17*b* to the warm side 51 at the lower pressure.

The arrangement 106 for return and control of cooling medium to the cooling circuit when increased capacity is required, can in the simplest embodiment be a valve or a pump for dosing of fluid into the cooling circuit. With the use of a valve, the flow of liquid back to one of the parts of the cooling circuit, which operate at the lower pressure, can take place by means of gravitational flow as a result of a height difference, or by the storage 104 operating at a higher pressure as described in FIG. 3 and the associated description.

With the use of a pump in the arrangement 106, it is also possible to return cooling medium to that part of the cooling circuit which operates at the higher pressure or a part operating at an intermediate pressure.

Figure 7:
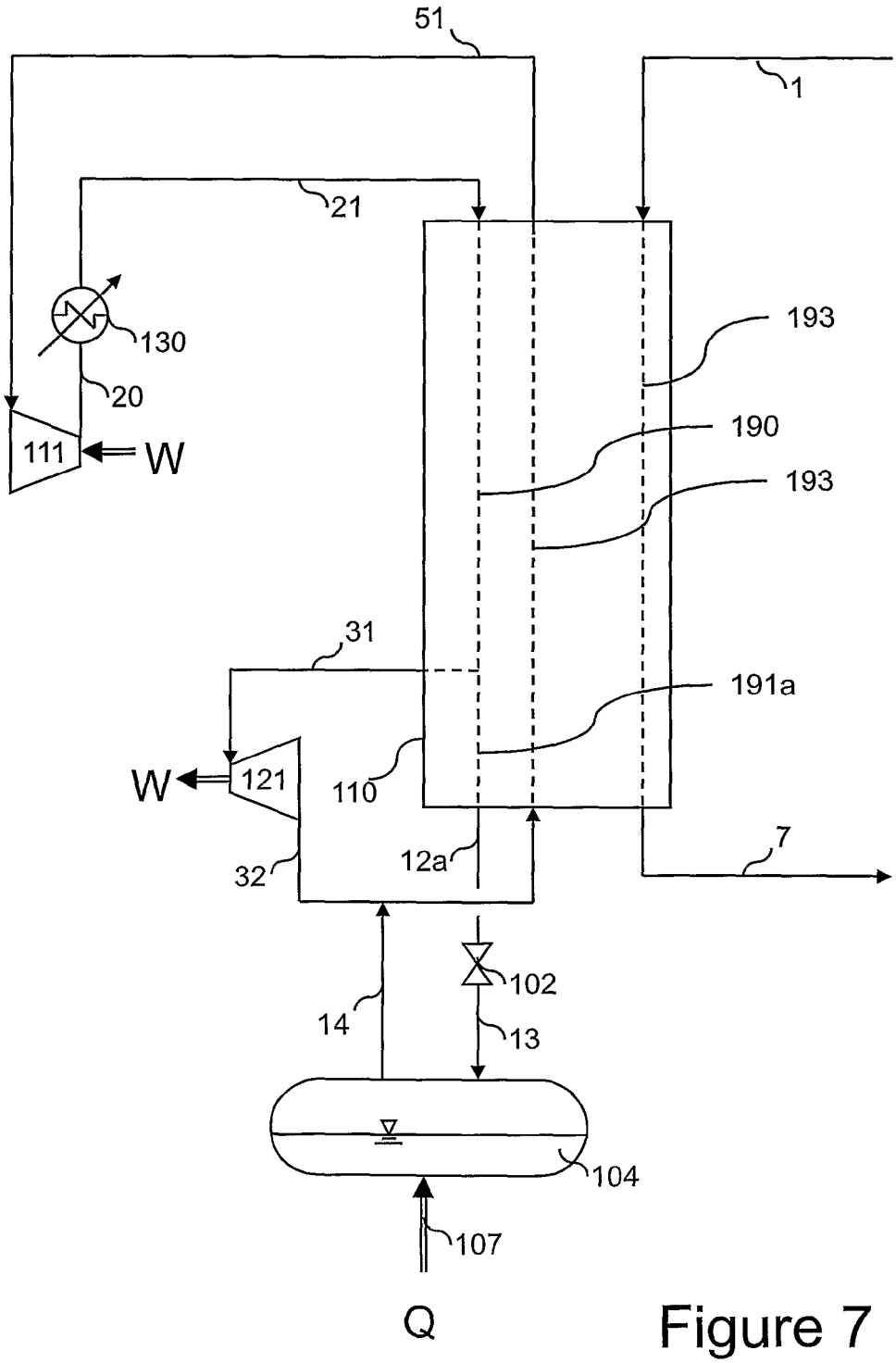
FIG. 7 shows the invention for a simple gas expansion circuit with an alternative embodiment.

FIG. 7 shows the invention applied in the simple gas expansion circuit with an alternative embodiment for return of cooling medium from the storage 104 to the cooling circuit, with an arrangement 107 being used to supply heat to the cold liquid cooling medium in 104. In this way, the liquid cooling medium in 104 is evaporated in a controlled way back to the cooling circuit via the gas line 14.

Figure 8:
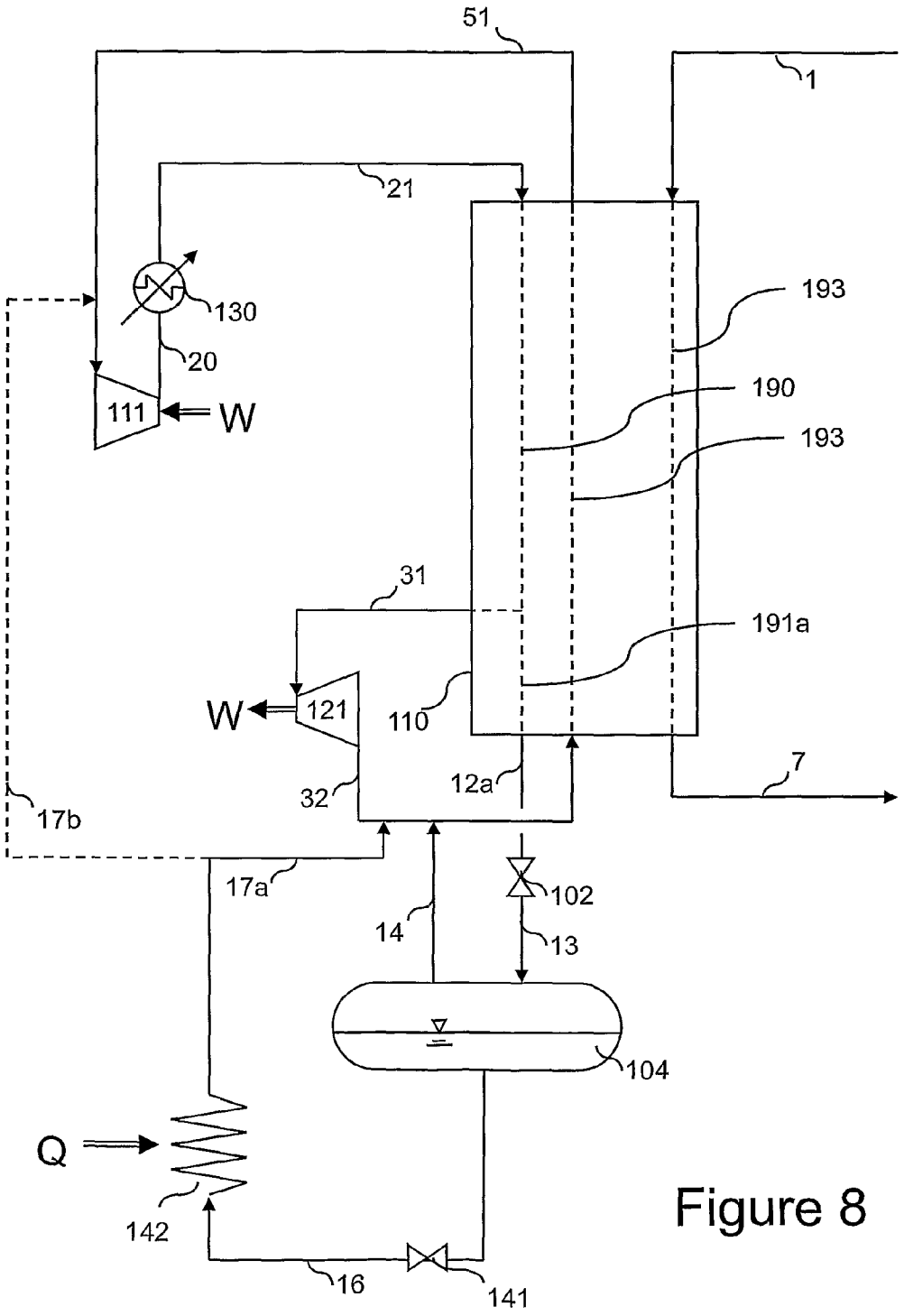
FIG. 8 shows the invention for a simple gas expansion circuit with an alternative embodiment.

FIG. 8 shows the invention used in the simple gas expansion circuit with an alternative embodiment for return of cooling medium from the storage 104 to the cooling circuit, in that an arrangement 143 external to the tank 104 is used to supply heat to the cold liquid cooling medium, and in this way the liquid cooling medium from 104 is evaporated in a controlled way back to the cooling circuit via the gas line 17*a*, 17*b* or a corresponding connection. The arrangement 143 can, for example, be a heat exchanger which uses air from the surroundings as a heat source, or other types of heat exchangers with an available warm medium as an energy source.

Figure 9:
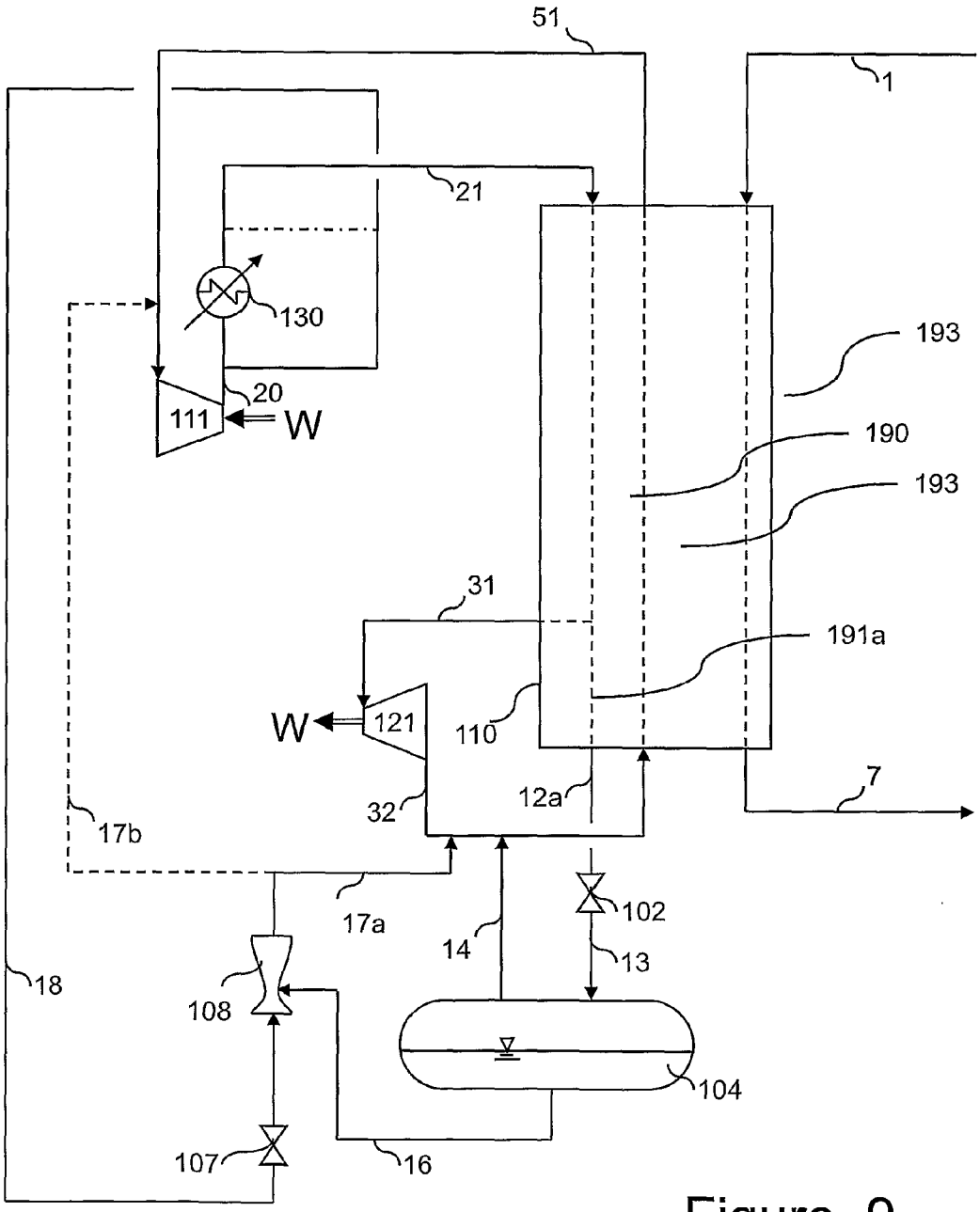
FIG. 9 shows the invention for a simple gas expansion circuit with an alternative embodiment.

FIG. 9 shows the invention used in the simple gas expansion circuit with an alternative embodiment for return of cooling medium from the storage 104 to the cooling circuit, in that an ejector/eductor 108 is being used to obtain a controlled flow of cooling medium back to a suitable location in the cooling circuit. The ejector 108 uses a limited amount of motive gas 18 from the high pressure side of the cooling circuit, for example, from outlet 20 of the compressor or from the cooling medium stream 21 downstream the cooler 130. The cooling medium can be returned to the part of the cooling circuit that has the lower pressure, for example, as stream 17*a* to the cold side 32 at the lower pressure or as stream 17*b* to the warm side 51 at the lower pressure. The ejector will give a complete or partial evaporation of the cold liquid 16 so that the returning cooling medium 17*a*/17*b* is no longer a pure, cold liquid with subsequent danger of unfavourable liquid/gas flow in the cooling circuit in the period return of cooling medium is carried out.

Figure 10:
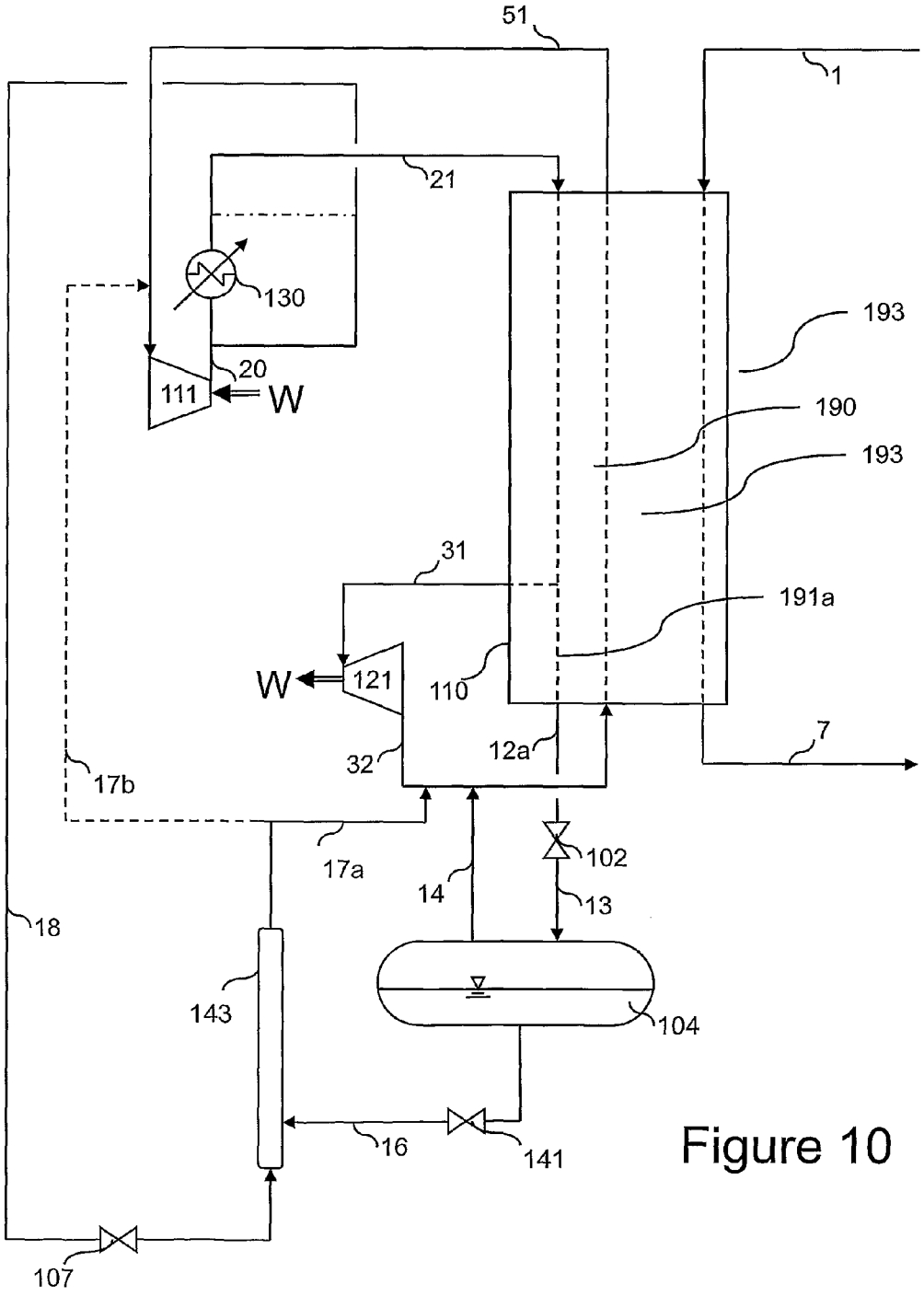
FIG. 10 shows the invention for a simple gas expansion circuit with an alternative embodiment.

FIG. 10 shows the invention used in the simple gas expansion circuit with an alternative embodiment for return of cooling medium from the storage 104 to the cooling circuit, with an external volume 143 being used, for example, a vessel or a pipe, preferably vertically, where a stream of liquid cooling medium 16 is led in a controlled way to said volume and is mixed with an amount of warmer gas 18 from the high pressure side of the cooling circuit, for example, from the outlet 20 of the compressor or from the cooling medium stream 21 downstream the cooler 130. The warmer gas 18 will then supply heat so that the desired amount of cooling medium is evaporated to gas and can be returned to the part of the cooling circuit which has the lowest pressure, for example, as stream 17*a* to the cold side 32 at the lower pressure or as stream 17*b* to the warm side 51 at the lower pressure. This set up will lead to a complete evaporation of the cold liquid 16 so that the returning cooling medium 17*a*/17*b* is no longer a cold liquid with subsequent risk of unfavourable liquid/gas flow in the cooling circuit during the period cooling medium return is carried out.

Figure 11:
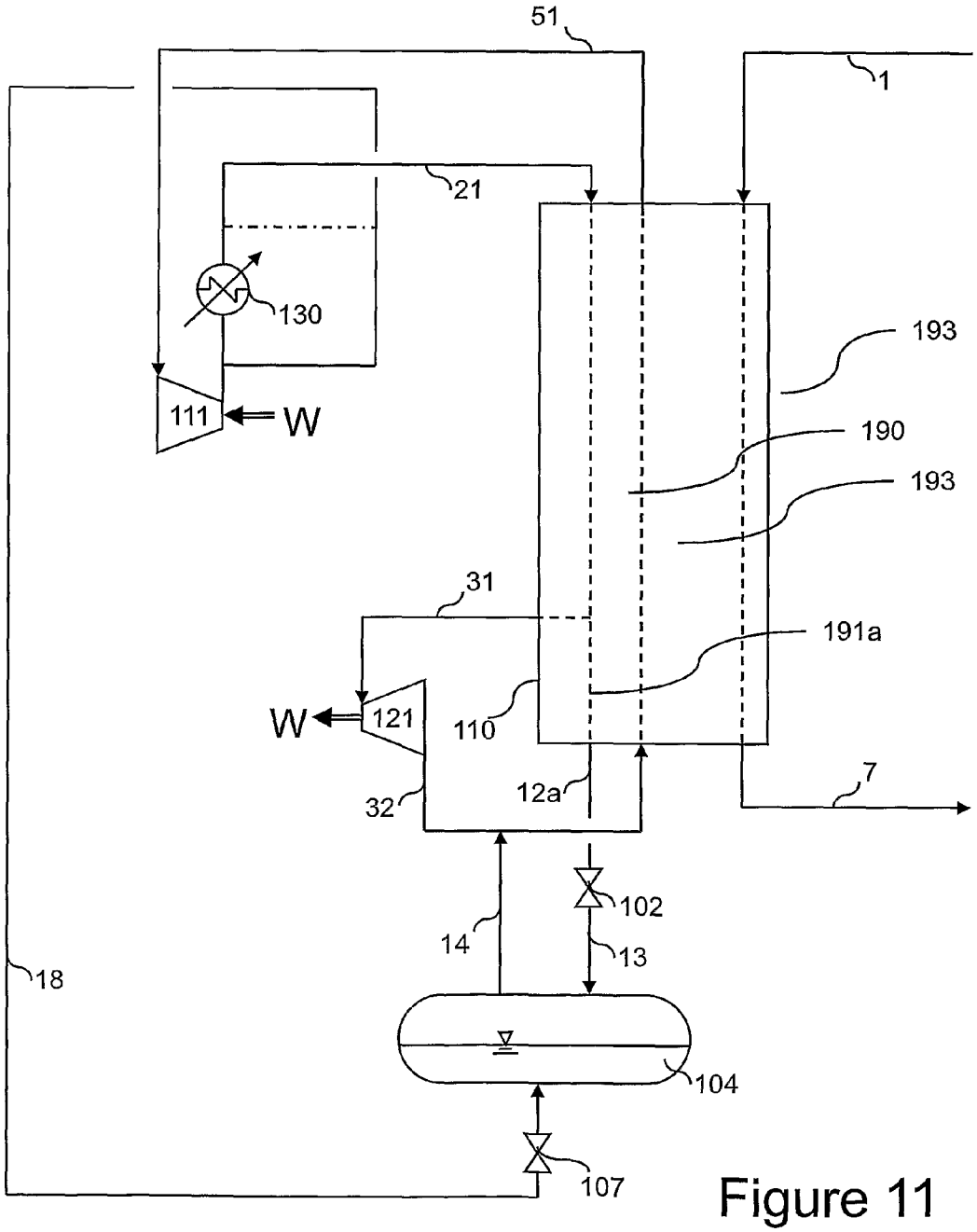
FIG. 11 shows the invention for a simple gas expansion circuit with an alternative embodiment.

FIG. 11 shows the invention applied in the simple gas expansion circuit with an alternative embodiment for return of cooling medium from the storage 104 to the cooling circuit, with an arrangement being used where a warmer cooling medium stream 18 is supplied from a location in the cooling circuit where the pressure is somewhat higher than in the storage 104, to be introduced in 104 via a suitable arrangement, for example, nozzles, so that the heat in the warmer gas contributes to a controlled evaporation of the cold liquid in 104. In this way, the liquid cooling medium in 104 is evaporated back into the cooling circuit via the gas line 14 in a controlled manner.

Figure 12:
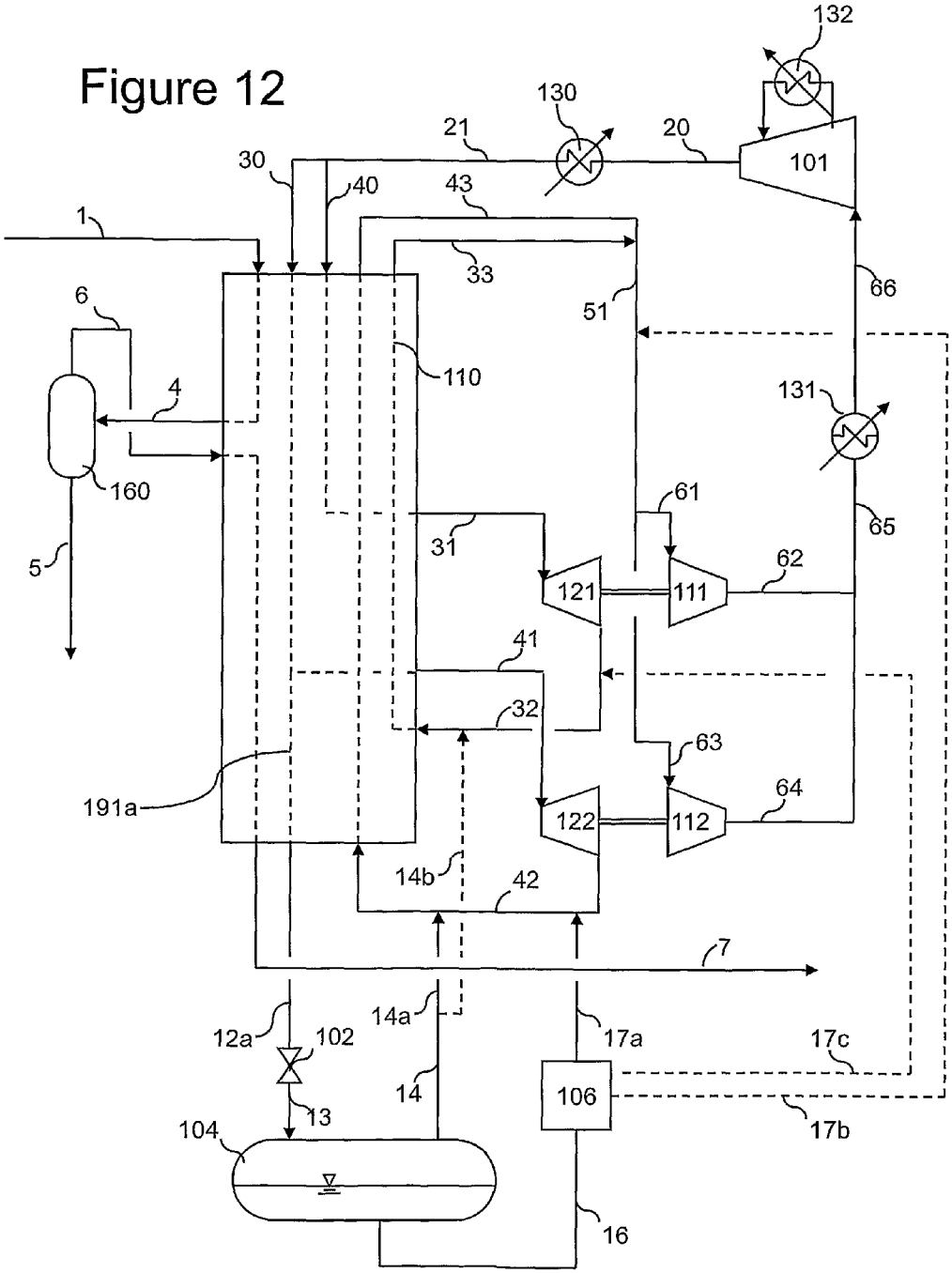
FIG. 12 shows the invention in a preferred embodiment for a two step gas expansion circuit.

A cooling system, for example for liquefaction of LNG, is often more comprehensive/involves more details than what is covered in the description above. However, the principles for the embodiment of the invention are the same. To illustrate this, a cooling system for liquefaction of natural gas to LNG by use of a double gas expansion circuit that uses pure nitrogen as cooling medium is shown in FIG. 12. A gas stream 1 comprising natural gas which shall be liquefied is cooled in more than one step in the heat exchanger 110 in that the gas is pre-cooled to an intermediate temperature 4 where heavier hydrocarbons can be separated as liquid in a separator or column 160. Pre-cooled gas 6 is then conducted back to the heat exchanger 110 for further cooling, condensing and subcooling, until the liquid exists as LNG in the product stream 7. The cooling circuit now comprises a gaseous cooling medium stream 21 at a higher pressure which is divided into two parts 30 and 40 which are pre-cooled to different temperatures in the heat exchanger 110. Stream 30 is pre-cooled to a lower temperature than the temperature in 30 and is expanded across gas expander 121 to generate a cold cooling medium stream 32 at a lower pressure. The cooling medium stream 32 is predominantly in a gas phase, but in some designs a small liquid fraction in equilibrium with the gas at the outlet of the expander/turbine can be allowed. Cold cooling medium 32 is returned to the heat exchanger 110 to contribute with cooling. Stream 40 is pre-cooled to a temperature lower than the temperature in 32 and is expanded across a gas expander 122 to generate a cold cooling medium stream 42 at a lower pressure. The cooling medium stream 42 is predominantly in a gas phase, but in some designs a small liquid fraction in equilibrium with the gas at the outlet of the expander/turbine can be allowed. Cold cooling medium 42 is returned to the heat exchanger 110 to ensure the cooling in the lowest temperature range. After warming up in 110 the cooling medium streams now exist as the gas streams 33 and 43 at the lower pressure. These gas streams can then be recompressed in one or more compression steps with or without intercooling. It must be pointed out that the splitting of the cooling medium stream must not necessarily take place before the heat exchanger 110, but can also take place as an integrated part of the heat exchanger 110 in that the pass divides the gas stream for outlet of a stream 31 in an intermediate outlet and for further cooling of the remaining gas 41. In the same way, the heating of the cold gas 32 and 42 can occur in such a way that the streams are mixed as an integrated part of the exchanger. In the same way as for the simple gas expansion circuit the embodiment of the invention starts in this context by extracting a cooling medium stream 191*a* at the higher pressure after pre-cooling in the heat exchanger pass 190, for further pre-cooling in 191*a* until a cold cooling medium stream 12*a* at the higher pressure exists. It is pointed out that all of the methods for separation of a side stream of cooling medium for further cooling described above and in the FIGS. 1-3 can be used in this set up also. Pre-cooled cooling medium 12 is expanded across a valve 102 to the lower pressure, or a pressure between the higher pressure and the lower pressure, but so that the temperature is reduced and a mixture 13 of gas and at least a fraction of liquid is generated. In this connection, the valve 102 controls the amount of cooling medium which is extracted from the cooling circuit. The gas and liquid in stream 13 are separated to a liquid fraction which can be stored in a storage tank/pressure tank/separator 104 at a suitable pressure, and a gas stream 14 at the lower pressure which is returned at a suitable location in the cooling circuit, for example, to stream 32 or 42 via 14*b* and 14*a*, respectively. When the system described above extracts cooling medium through pass 191*a* and via the valve 102 and liquid is generated in 104, the content of cooling medium in the cooling circuit is correspondingly reduced and the capacity of the cooling installation is reduced. When the capacity shall be increased again, a suitable arrangement 106 to return cooling medium 16 from 104 to the cooling circuit is used, preferably to the part of the cooling circuit that has the lower pressure, for example, as stream 17*a* to the cold side 32 at the lower pressure, or as stream 17*c* to the cold side 42 at the lower pressure, or as stream 17*b* to the warm side 51 at the lower pressure. All the alternative methods described above for return of the cooling medium to the cooling circuit can also be used.

It must be pointed out that in all embodiments of the invention the gas stream 14 can be returned to other locations in the cooling circuit than those described through the figures and the examples given above, as long as the pressure is low enough, and the invention is not limited to the examples described here.

It is pointed out that in all embodiments of the invention the cooling medium 17 can be returned to other locations in the cooling circuit than those described in the figures and in the examples given above as long as the pressure is sufficiently low with regard to the method which is used for the return, and the invention is not limited to the examples described here.

In all the embodiments of the invention described above and in the figures, the cooling medium tank can be set up as a horizontal tank or a vertical tank. Furthermore, the cooling medium tank 104 can be a conventional tank or a double walled vacuum-insulated tank which is normally used for storing cryogen/low temperature liquids and liquid gases.

Furthermore, the cooling medium tank 104 can be placed in the vicinity of the cooling system 100 and the heat exchanger system 110 and can be insulated to minimise evaporation as a consequence of heat transfer from the surroundings. In an alternative embodiment the cooling medium tank 104 can be placed together with the heat exchanger system 110 inside a closed and limited volume which is filled with insulation material to limit heat transfer from the surroundings. The insulated volume is often shaped as a box and is normally described as a "cold box". The insulating material can be conventional insulation or granular insulating material which is filled into the box, such as perlite.

In an alternative embodiment the cooling medium tank 104 can also be used as cooling medium storage, for example, where the cooling medium is nitrogen, and such that the cooling medium tank can supply other parts of the processing installation with liquid or gaseous nitrogen when required.

The invention claimed is:

1. A method for reducing an operating pressure, reducing a cooling medium mass flow rate and reducing a cooling duty from a full cooling duty of a cooling circuit during continued operation of the cooling circuit, wherein a gaseous cooling medium goes through a work cycle including compression, pre-cooling at a first pressure and expansion to a first low pressure lower than said first pressure in order to generate a cold gas cooling medium which is used to cool a fluid that is to be liquefied and to pre-cool the compressed gaseous cooling medium at said first pressure, comprising the following steps:

reducing the amount of cooling medium circulating in the cooling circuit during continued operation of the cooling circuit in that a fraction of cooling medium is pre-cooled at said first pressure and is removed from the cooling circuit;

said removed fraction of pre-cooled cooling medium being pre-cooled to a lower temperature than the lowest temperature that the cooling medium remaining in the cooling circuit is pre-cooled to in the cooling circuit;

thereafter expanding said removed fraction of pre-cooled cooling medium across an expansion device to a second low pressure between said first pressure and said first low pressure, whereby at least a portion of said removed fraction of pre-cooled cooling medium is condensed;

separating said condensed portion from a non-condensed remainder of said expanded removed fraction;

returning said non-condensed remainder of said expanded removed fraction to the cooling circuit;

storing said condensed portion in a storage unit, whereby the cooling circuit operates with the reduced amount of cooling medium, the reduced operating pressure and the reduced cooling duty; and in order to restore the full cooling duty immediately after the reduced cooling duty, during continued operation of the cooling circuit and during an increased heat load on the cooling circuit, returning the stored condensed portion from the storage unit to the cooling circuit to increase the operating pressure and the cooling medium mass flow rate in the cooling circuit and thereby restore the full cooling duty of the cooling circuit.

2. A method according to claim 1, wherein said step of reducing the amount of cooling medium causes the reduced cooling duty and a reduction in compression work.

3. A method according to claim 2, wherein the cooling circuit is disposed in a cooling system for liquefaction of natural gas to LNG.

4. A method according to claim 1, wherein said expansion device is a valve.

5. A method according to claim 1, wherein said gaseous cooling medium is composed of more than 90% nitrogen.

6. A method according to claim 1, further comprising the step of returning evaporated cooling medium from the condensed portion in the storage unit to the cooling circuit.

7. A method according to claim 1 further comprising the step of operating the storage unit at the same pressure as the first low pressure, wherein the storage unit has a connection without restrictions to the part of the cooling circuit operated at said first low pressure.

* * * * *